US005211000A

United States Patent [19]

Fink et al.

[11] Patent Number: 5,211,000

[45] Date of Patent: May 18, 1993

[54] CONVEYING MECHANISMS FOR DOFFED TAKE-UP PACKAGES OF PROCESSED YARN AND EMPTY YARN SUPPLY PACKAGE BOBBINS IN A TEXTILE YARN PROCESSING MACHINE

[75] Inventors: Heinz Fink, Krefeld; Wolfgang Leupers, Monchen-Gladbach, both of Fed. Rep. of Germany

[73] Assignee: Palitex Project Company GmbH, Krefeld, Fed. Rep. of Germany

[21] Appl. No.: 730,665

[22] Filed: Jul. 16, 1991

[30] Foreign Application Priority Data

Jul. 21, 1990 [DE] Fed. Rep. of Germany ..... 4023221

[51] Int. Cl.[5] ..... D01H 9/02; D01H 9/18

[52] U.S. Cl. ..... 57/281; 57/90; 242/35.5 A

[58] Field of Search ..... 57/281, 90, 266; 242/35.5 A

[56] References Cited

U.S. PATENT DOCUMENTS

| | | | |
|---|---|---|---|
| 3,552,666 | 1/1971 | Stenmans | 242/35.5 R |
| 3,998,397 | 12/1976 | Haberkorn | 242/35.5 A |
| 4,181,228 | 1/1980 | Hashimoto et al. | 57/281 X |
| 4,660,367 | 4/1987 | Kawarabashi | 57/281 X |
| 4,753,065 | 6/1988 | Mack et al. | 57/281 X |
| 4,769,982 | 9/1988 | Kogiso et al. | 57/281 |
| 4,843,811 | 7/1989 | Yamamoto et al. | 57/281 |
| 4,856,270 | 8/1989 | Langen et al. | 57/281 |
| 4,942,967 | 5/1988 | Sanno et al. | 242/35.5 A |
| 5,024,389 | 6/1991 | Grecksch et al. | 242/35.5 A |

FOREIGN PATENT DOCUMENTS 1685944 8/1974 Fed. Rep. of Germany .

*Primary Examiner*—Joseph J. Hail, III

*Attorney, Agent, or Firm*—Bell, Seltzer, Park & Gibson

[57] ABSTRACT

A textile yarn processing machine, particularly a two-for-one twister, having a plurality of yarn processing stations positioned in side-by-side relationship in at least one row extending in the longitudinal direction of the machine and each station including a spindle assembly containing one or more supply packages of yarn wound on bobbins to be processed in such station and a take-up mechanism for winding yarn processed in such station on to bobbins to form take-up packages is provided with first and second conveying mechanisms for respectively receiving doffed take-up packages of processed yarn and empty yarn supply package bobbins at each yarn processing station and conveying same to one end of the machine for removal from the machine. The first conveying mechanism includes two driven endless conveyor belts laterally spaced from each other and the second conveying mechanism is positioned generally in the space between the lower runs of the spaced conveyor belts forming the first conveying mechanism to preserve any necessity for unnecessary increase in height or other dimensions of the machine.

12 Claims, 3 Drawing Sheets

FIG. 1
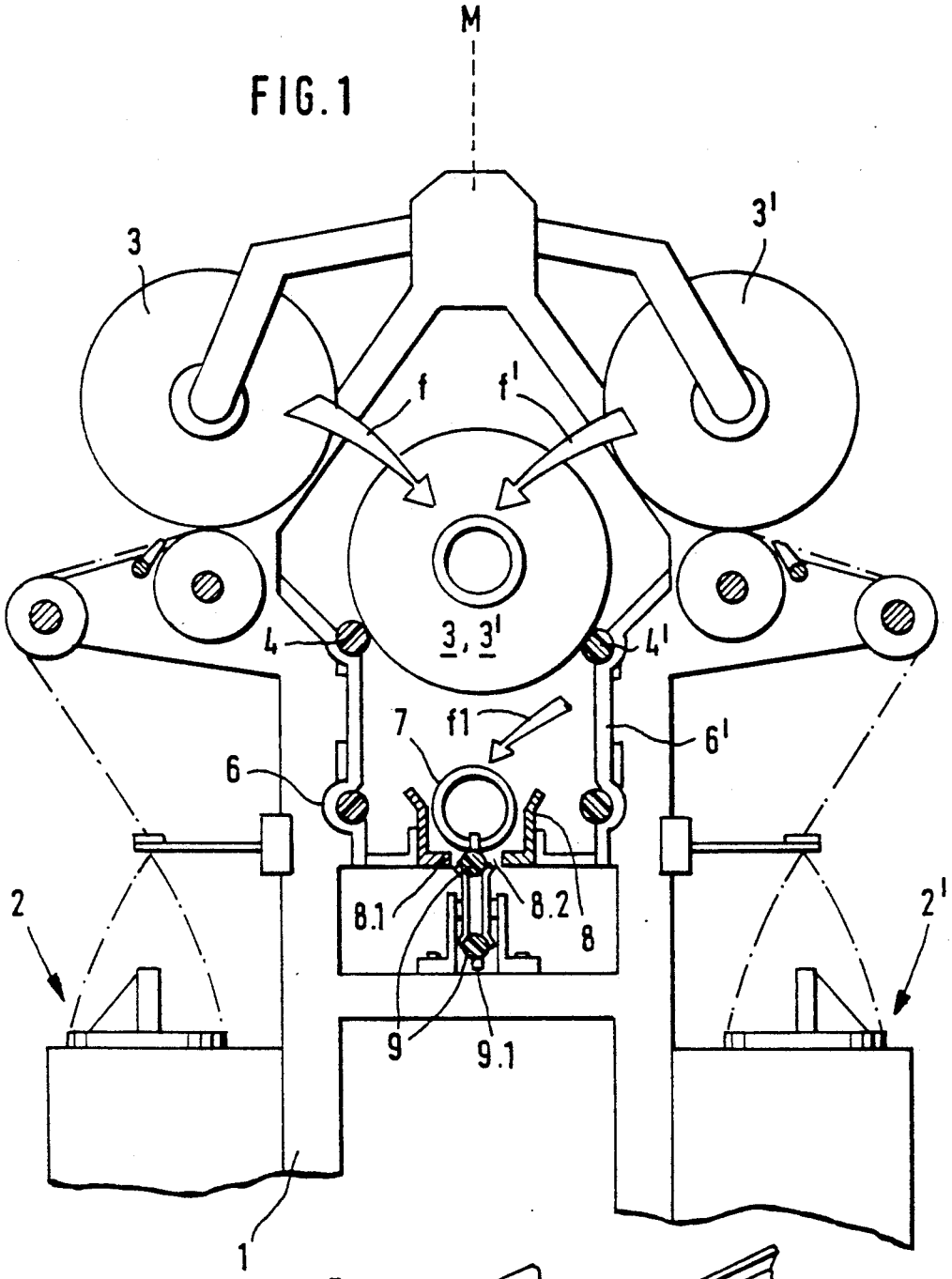
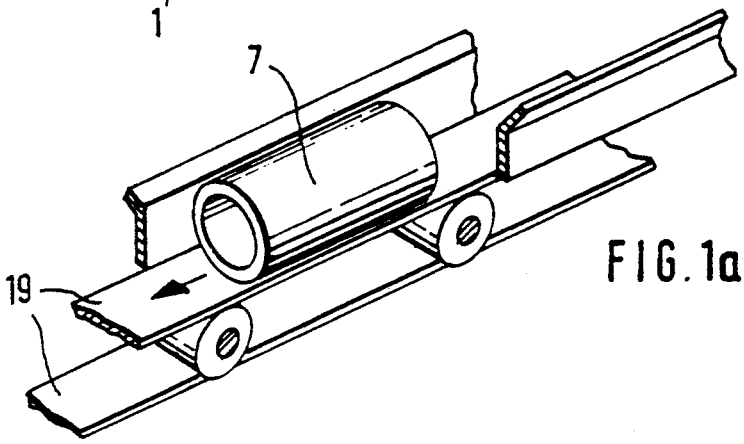
FIG. 1a

CONVEYING MECHANISMS FOR DOFFED TAKE-UP PACKAGES OF PROCESSED YARN AND EMPTY YARN SUPPLY PACKAGE BOBBINS IN A TEXTILE YARN PROCESSING MACHINE

FIELD OF THE INVENTION

This invention relates to conveying mechanisms positioned longitudinally in a textile yarn processing machine, particularly a two-for-one twister, for receiving and conveying doffed take-up packages of processed yarn and empty yarn supply package bobbins from each yarn processing station to one end of the machine.

BACKGROUND OF THE INVENTION

Such textile yarn processing machines, particularly two-for-one twisters, include a plurality of yarn processing stations positioned in side-by-side relationship in the longitudinal direction of the machine and in at least one row and preferably two rows extending longitudinally on respective opposite sides of the machine. Conveying mechanisms utilizing endless conveyor belts have been arranged centrally of such machine between the two rows of work stations to extend longitudinally of the machine and which are adapted to receive doffed take-up packages of processed yarn after the yarn has been processed in a spindle assembly and wound into take-up packages in a take-up mechanism at each yarn processing station of the machine. These conveying mechanisms were adapted to transport the doffed take-up packages from such yarn processing stations to one end of the machine for removal from the machine. Such prior conveying mechanisms in a yarn processing machine of this type are disclosed in published German Patent DE-PS 16 85 944 and U.S. Pat. No. 3,552,666.

In textile yarn processing machines of this type, provisions must also be made for removing empty supply yarn package bobbins from each yarn processing station after the yarn from such supply packages has been exhausted during yarn processing operations. The empty bobbins are cleaned of any yarn residue and rewound with yarn for subsequent yarn processing operations.

Accordingly, a need is present to provide conveying mechanisms in a textile yarn processing machine of the type discussed, particularly a two-for-one twister, for conveying both doffed take-up packages of processed yarn and empty yarn supply package bobbins from each yarn processing station to one end of the machine for conveying or removal from the machine for subsequent handling. It is also necessary to provide such conveying mechanisms without the necessity of increasing the height or other dimensions of the textile yarn processing machine to any considerable extent.

OBJECT AND SUMMARY OF THE INVENTION

It is the object of this invention to fill the above described need in a textile yarn processing machine of the type discussed for conveying both doffed take-up packages of processed yarn and empty yarn supply package bobbins from each yarn processing station to one end of the machine to be removed or conveyed from the machine for subsequent handling.

In accordance with the present invention, this object is accomplished by providing first and second conveying means in a textile yarn processing machine, particularly a two-for-one twister, having a plurality of yarn processing stations positioned in side-by-side relationship in at least one row extending in the longitudinal direction of the machine. Each of the yarn processing stations includes a spindle assembly containing one or more supply packages of yarn wound on bobbins to be processed in such station and a take-up mechanism for winding yarn processed in such station on to bobbins to form take-up packages.

The first conveying means is mounted to extend longitudinally of the machine and is positioned to receive doffed take-up packages of processed yarn at each yarn processing station and convey such take-up packages to one end of the yarn processing machine. The first conveying means includes two driven endless conveyor belts laterally spaced from each other and defining generally horizontally-extending upper and lower runs of each of the belts for receiving doffed take-up packages on the upper runs. Preferably, lateral support means are provided for the endless conveyor belts which support the belts from the side and also, preferably, from below.

The second conveying means is mounted to extend longitudinally of the machine to receive doffed empty yarn supply package bobbins at each yarn processing station and convey such bobbins to one end of the yarn processing machine. Preferably, the second conveying means includes a driven endless conveyor belt defining generally horizontally-extending upper and lower runs for receiving the doffed empty yarn supply bobbins on the upper run, a stationary longitudinally and horizontally-extending channel member having an open top side for receiving the bobbins into the channels and a longitudinally-extending slot in the bottom side which is adapted to receive the upper run of the endless conveyor belt of the second conveying means therethrough for conveying the bobbins along the channel, and entrainment means mounted on the endless conveyor belt in longitudinally spaced positions to protrude outwardly for aiding in conveying the bobbins. The channel member and the upper run of the conveyor belt forming the second conveying means is positioned generally in the space between the lower runs of the spaced conveyor belts forming the first conveying means.

Preferably, the endless conveyor belts of the first conveying means each comprise a generally round cross-section belt. The endless conveyor belt of the second conveying means may preferably comprise a generally round cross-section belt or a generally flat cross-section belt. As a result of the use of two individual endless conveyor belts, preferably of the type having a generally round cross-section, as the first conveying means for receiving and conveying the doffed take-up packages of processed yarn, a space is provided between these two endless conveyor belts and the lower run thereof for positioning the second conveying means for receiving and conveying the empty supply yarn package bobbins. This arrangement, of course, preserves space and allows the use of two conveying means or mechanisms without substantially increasing the height or other dimensions of the textile yarn processing machine.

BRIEF DESCRIPTION OF THE DRAWINGS

FIG. 1 shows in diagrammatic representation a vertical section of a two-for-one twisting machine perpendicular to the longitudinal axis of the machine;

FIG. 1*a* is a modified embodiment of a detail of the machine according to FIG. 1;

DETAILED DESCRIPTION OF PREFERRED EMBODIMENTS OF THE INVENTION

Figure 2:
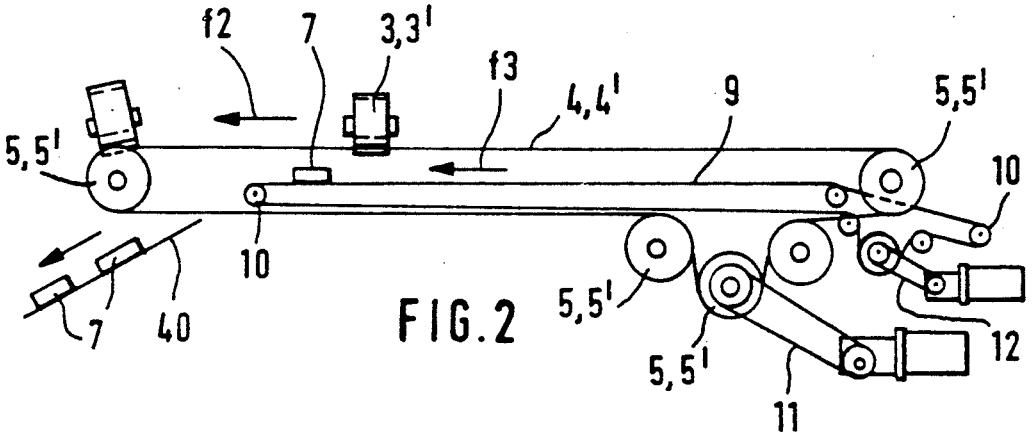
FIG. 2 shows in diagrammatic representation a side view of the two conveying mechanisms arranged in the region of the central plane of the machine.

FIG. 1 shows the machine frame 1 of a double-sided two-for-one twisting textile yarn processing machine which has, symmetrically to the central plane of the machine indicated by the broken line M, two parallel-extending rows of yarn processing or two-for-one twisting stations, which are in each case represented by a two-for-one twisting spindle assembly 2, 2'. The yarns drawn off from bobbins of yarn supply packages inserted into the individual spindle assemblies 2, 2' are wound-up above the spindle assemblies 2, 2' at take-up mechanisms to form take-up packages of processed yarn 3, 3'. The take-up packages 3, 3' are conveyed in the direction of the arrows f, f' into the region of the center of the machine and deposited there onto an endless conveyor, which in accordance with the invention consists of preferably round individual belts 4, 4' which lie at a lateral spacing from one another. The individual belts run in the customary manner over partially driven guide rollers 5 or respectively 5' which are rotatable about horizontal axes. In order, with the take-up packages 3, 3' placed onto the individual belts 4, 4', to avoid a lateral pressing-apart of the individual belts 4, 4', lateral supporting elements 6, 6' are provided, which can either extend over the entire length of the machine or butt only at points against the individual belts 4 or respectively 4'.

Figure 3:
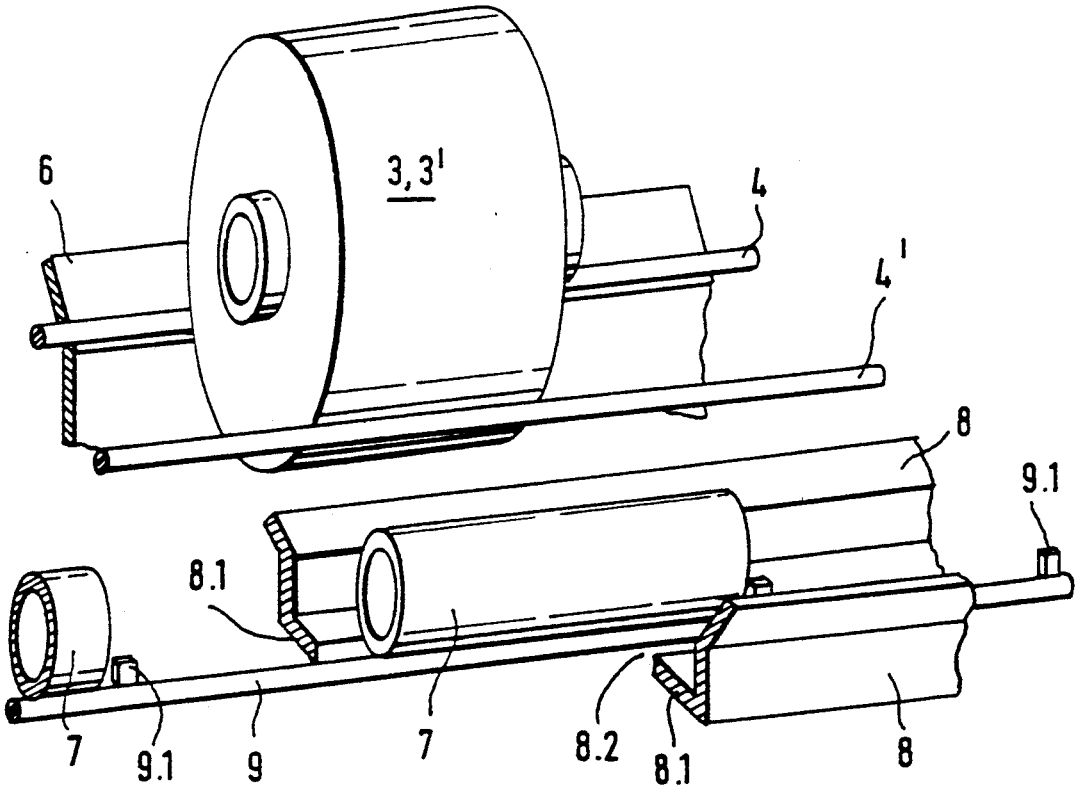
FIG. 3 shows fragmentarily in partially perspective representation partial view of the two conveying mechanisms.
Figure 4:
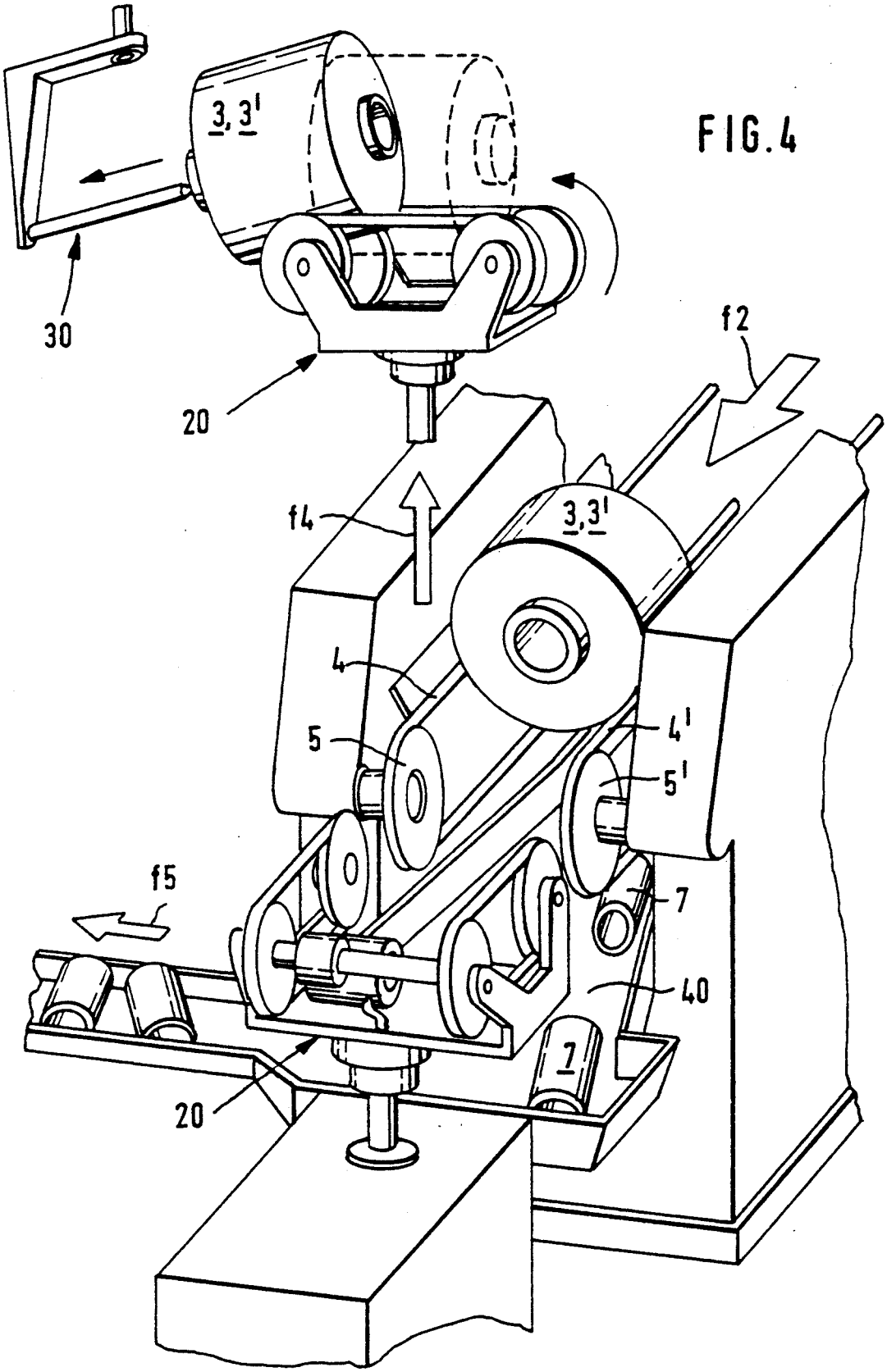
FIG. 4 shows fragmentarily a perspective view of the end face of a twisting machine.

Provided in the region of the lower runs of the two individual belts 4, 4', in the region of the central plane M of the machine, is a further conveying mechanism for the transporting away of empty yarn supply package bobbins 7 removed from the spindle assembly 2 or respectively 2'. This empty-bobbin conveying mechanism consists, in accordance with FIG. 1, of a conveying channel member 8 which extends in the longitudinal direction of the machine and in the bottom 8.1 of which a longitudinal slot 8.2 is arranged. The upper run of a second, preferably circular, endless conveyor belt 9 projects through this longitudinal slot. This endless conveyor belt is provided with outwardly protruding entrainment means 9.1, which in accordance with FIGS. 1 and 3 ensure a reliable entrainment of the empty bobbins 7 inserted in the direction of the arrow fl into the conveying channel 8. The endless belt 9 is likewise conducted over partially driven guide rollers 10.

As shown in FIG. 1*a*, the bottom of the conveying channel 8 can be formed substantially by a flat belt 9 for the transportation of the empty bobbins 7.

The drive of the individual belts 4, 4', forming the first conveying mechanism, in the conveying direction f2 is effected by way of a suitable transmission 11, as is shown for example in FIG. 2. An exemplary drive for the individual belt 9 in the conveying direction f3 is likewise effected by way of a transmission roller 12 and suitably arranged guide rollers, see FIG. 2.

For the further transport of the take-up packages 3, 3' conveyed by means of the individual belts 4, 4' to the one end of the machine, provided in the region of this end of the machine is a lifting mechanism 20, which comprises a belt conveyor which can be moved up and down in the direction of the arrow f4 and which is rotatable about its lifting axis, in order to transfer full run-up bobbins 3 or respectively 3' to an overhead conveying mechanism 30.

For further transport of the empty bobbins 7, linking on to the endless conveyor belt 9 is a chute 40, onto which the empty bobbins are jettisoned from the endless belt. The bobbins are then further conveyed in a suitable manner, for example by means of a further conveying unit or under the influence of the force of gravity, in the direction of the arrow f5.

A particular advantage of the first conveying mechanism, consisting of two individual belts 4, 4', for the wound take-up yarn packages 3, 3' consists, compared with an otherwise customary flat belt, in the small contact surface area between the package periphery and the conveying mechanism and additionally in a simplified keeping-clean of the conveying mechanism against getting covered in dust. The more planar a means of transport is designed, the more dust and bits of fluff can adhere thereto.

What is claimed is:

1. A two-for-one twister textile yarn processing machine having a plurality of yarn processing stations positioned in side-by-side relationship in at least one row extending in the longitudinal direction of said machine, each of said yarn processing stations including a spindle assembly containing one or more supply packages of yarn wound on bobbins to be processed in said station and a take-up mechanism for winding yarn processed in said station onto bobbins to form take-up packages; wherein the improvement comprises:

first conveying means mounted to extend longitudinally and generally the full length of said machine and positioned to receive take-up packages of processed yarn from said take-up mechanism at each yarn processing station and convey such take-up packages to one end of said machine, said first conveying means including two driven endless conveyor belts laterally spaced from each other and defining generally horizontally-extending upper and lower runs of each of said belts for receiving take-up packages on said upper runs; and second conveying means mounted to extend longitudinally generally the length of said machine in the space between said lower runs of said spaced conveyor belts forming said first conveying means to receive empty yarn supply package bobbins from said spindle assembly at each yarn processing station and convey such bobbins to one end of said machine.

2. A textile yarn processing machine, as set forth in claim 1, in which said second conveying means comprises a driven endless conveyor belt defining generally horizontally-extending upper and lower runs for receiving the doffed empty yarn supply package bobbins on said upper run, and said upper run of said conveyor belt of said second conveying means being positioned generally in the space between said lower runs of said spaced conveyor belts forming said first conveying means.

3. A textile yarn processing machine, as set forth in claim 2, in which said second conveying means further includes a stationary longitudinally and horizontally-extending channel member having an open top side for receiving the bobbins into said channel and a longitudinally-extending slot in the bottom side which is adapted to receive said upper run of said endless conveyor belt of said second conveying means therethrough for conveying the bobbins along said channel.

4. A textile yarn processing machine, as set forth in claim 3, in which said second conveying means further includes entrainment means mounted on said endless belt in longitudinally spaced positions to protrude outwardly for aiding in conveying the bobbins.

5. A textile yarn processing machine, as set forth in claim 3, in which there is further provided means at the end of said machine attached to said channel member for receiving the bobbins from said conveyor belt of said second conveying means and for allowing movement of the bobbins out of said machine.

6. A textile yarn processing machine, as set forth in claim 1, in which said first conveying means further includes lateral supporting means for said spaced endless conveyor belts.

7. A textile yarn processing machine, as set forth in claim 6, in which said lateral support means also includes means to support said conveyor belts from below.

8. A two-for-one twister textile yarn processing machine having a plurality of yarn processing stations positioned in side-by-side relationship in at least one row extending in the longitudinal direction of said machine, each of said yarn processing stations including a spindle assembly containing one or more supply packages of yarn wound on bobbins to be processed in said station and a take-up mechanism for winding yarn processed in said station onto bobbins to form take-up packages wherein the improvement comprises;

first conveying means mounted to extend longitudinally and generally the full length of said machine and positioned to receive take-up packages of processed yarn from said take-up mechanism at each yarn processing station and convey such take-up packages to one end of said machine, said first conveying means including two driven endless conveyor belts laterally spaced from each other and defining generally horizontally-extending upper and lower runs of each of said belts for receiving take-up packages on said upper runs ,and lateral supporting means for said endless conveyor belts which support said belts from the side and from below; and second conveying means mounted to extend longitudinally generally the length of said machine to receive empty yarn supply package bobbins from said spindle assembly at each yarn processing station and convey such bobbins to one end of said machine, said second conveying means including a driven endless conveyor belt defining generally horizontally-extending upper and lower runs for receiving the empty yarn supply bobbins on said upper run, a stationary longitudinally and horizontally-extending channel member having an open top side for receiving the bobbins into said channel and a longitudinally-extending slot in the bottom side which is adapted to receive said upper run of said endless conveyor belt of said second conveying means therethrough for conveying the bobbins along said channel, and entrainment means mounted on said endless conveyor belt in longitudinally spaced positions to protrude outwardly for aiding in conveying the bobbins, said channel member and said upper run of said conveyor belt forming said second conveying means being positioned generally in the space between said lower runs of said spaced conveyor belts forming said first conveying means.

9. A textile yarn processing machine, as set forth in claim 1, 2, 3, 4, 5, 6, 7 or 8, in which each of said endless conveyor belts of said first conveying means comprise a generally round cross-section belt.

10. A textile yarn processing machine, as set forth in claim 2, 3, 4, 5 or 8, in which said endless conveyor belt of said second conveying means comprises a generally round cross-section belt.

11. A textile yarn processing machine, as set forth in claim 2, 3, 4, 5 or 8, in which said endless conveyor belt of said second conveying means comprises a generally flat cross-section belt.

12. A textile yarn processing machine, as set forth in claim 2, 3, 4, 5 or 8, in which each of said endless conveyor belts of said first and second conveying means comprise a generally round cross-section belt.

* * * * *

UNITED STATES PATENT AND TRADEMARK OFFICE

CERTIFICATE OF CORRECTION

PATENT NO. : 5,211,000

DATED : May 18, 1993

INVENTOR(S) : Heinz Fink and Wolfgang Leupers

It is certified that error appears in the above-identified patent and that said Letters Patent is hereby corrected as shown below:

On the Title page, item [56]
UNDER REFERENCES CITED:

"4,942,967" should be -- 4,742,967 --.

Signed and Sealed this

Eleventh Day of January, 1994

Bruce Lehman

*Attest:*

BRUCE LEHMAN

*Attesting Officer*

*Commissioner of Patents and Trademarks*